US009766585B2

(12) United States Patent
Uchida

(10) Patent No.: US 9,766,585 B2
(45) Date of Patent: Sep. 19, 2017

(54) POWER LINE RETAINING MEMBER HAVING A GROOVE AND A RESTRICTING PORTION, AND IMAGE FORMING DEVICE

(71) Applicant: Konica Minolta, Inc., Chiyoda-ku, Tokyo (JP)

(72) Inventor: Satomi Uchida, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/212,801

(22) Filed: Jul. 18, 2016

(65) Prior Publication Data

US 2017/0023902 A1 Jan. 26, 2017

(30) Foreign Application Priority Data

Jul. 21, 2015 (JP) ..... 2015-143921

(51) Int. Cl.
*G03G 15/00* (2006.01)

(52) U.S. Cl.
CPC ..... *G03G 15/80* (2013.01)

(58) Field of Classification Search
CPC ..... G03G 15/80; H01B 17/14; H01B 17/16
USPC ..... 399/90
See application file for complete search history.

(56) References Cited

U.S. PATENT DOCUMENTS

2013/0223869 A1* 8/2013 Oda ..... G03G 15/0863 399/90
2015/0378303 A1* 12/2015 Ohata ..... G03G 21/1652 399/90

FOREIGN PATENT DOCUMENTS

JP 2009110996 A 5/2009
JP 2012195225 A 10/2012

* cited by examiner

*Primary Examiner* — Billy Lactaoen
(74) *Attorney, Agent, or Firm* — Cantor Colburn LLP

(57) ABSTRACT

A power line retaining member that houses, in a groove, a power line for connecting two separate components of an image forming device, the power line being a bare metal wire that has elasticity. The power line retaining member includes a guide and a restricting portion. The guide includes two side walls, internal wall surfaces of the two side walls and a bottom surface between the internal wall surfaces being electrically insulative and defining the groove, the guide holding the power line in an elastically deformed shape. The restricting portion is disposed on an internal wall surface that the power line exerts a restoring force against, the restricting portion restricting movement of the power line in a direction away from the bottom surface.

10 Claims, 12 Drawing Sheets

<Embodiment>

<Comparative example>

POWER LINE RETAINING MEMBER HAVING A GROOVE AND A RESTRICTING PORTION, AND IMAGE FORMING DEVICE

CROSS REFERENCE TO RELATED APPLICATIONS

The present invention claims priority under 35 U.S.C. §119 to Japanese Application No. 2015-143921 filed Jul. 21, 2015, the entire content of which is incorporated herein by reference.

BACKGROUND OF THE INVENTION (1) Field of the Invention

The present invention relates to power line retaining members and image forming devices equipped with same, a power line retaining member housing and holding a power line for connecting two separate components in an image forming device.

(2) Related Art

An image forming device, such as a printer, is typically configured so power from a power supply board disposed in the device body is supplied via power lines to imaging units, which include elements such as photoreceptor drums, chargers, and developing units. Typically, the power supply board is disposed a certain distance from the imaging units due to device design. Thus, power lines that connect the power supply board and the imaging units are held by wire retaining members to avoid sagging of the power lines.

As a power line, a wire harness of wires made of copper covered with an insulating material such as resin can be used, but wire harnesses are typically costly. In particular, a high voltage power line such as one used in charging requires a thick wire diameter, increasing the significance of increased costs.

Thus, a power line less costly than a wire harness, for example a bare metal wire such as stainless steel that is not insulated, may be used to connect terminals of the power supply board and terminals of the imaging units.

When multiple bare wires between the power supply board and the imaging units are held by a power line retaining member, the bare wires are usually bent at several places as they cannot be fitted in straight lines due to the disposition of the power supply board and the imaging units.

Thus, an insulating power line retaining member made of resin or similar is pre-formed with a guide that defines grooves in bent shapes into which the bare wires are fitted, and during manufacture typically a worker performs assembly by bending and fitting the bare wires into the bent portions of corresponding grooves.

After this assembly, while bare wires are housed in grooves of the power line retaining member, a short will not occur between the bare wires and, for example, a frame of the device body.

However, due to vibrations and the like when the device is in operation, bare wires housed in the grooves of the power line retaining member may gradually lift out of and eventually leave the grooves. When this occurs, a bare wire may come into contact with the frame of the device body or another bare wire, causing a short.

As ways of preventing this lifting of bare wires, in addition to the power line retaining member, holding members may be fixed into the grooves to hold down the bare wires at intervals along the lengths of the bare wires, or the bare wires may be bonded to the power line retaining member, but these require another manufacturing step in addition to the one of fitting the bare wires into the grooves.

This technical problem is not limited to connecting the power supply board to the imaging units, and may also occur when electrically connecting any two parts of the image forming device.

SUMMARY OF THE INVENTION

An aim of the present invention is to provide a power line retaining member and an image forming device equipped with the power line retaining member that, when power lines composed of bare wires are housed in grooves of a guide of the power line retaining member, prevent the power lines from lifting out of the grooves and improve ease of assembly.

In order to achieve this aim, a power line retaining member that reflects one aspect of the present invention houses, in a groove, a power line for connecting two separate components of an image forming device, the power line being a bare metal wire that has elasticity, the power line retaining member comprising: a guide that includes two side walls, internal wall surfaces of the two side walls and a bottom surface between the internal wall surfaces being electrically insulative and defining the groove, the guide holding the power line in an elastically deformed shape; and a restricting portion disposed on an internal wall surface that the power line exerts a restoring force against, the restricting portion restricting movement of the power line in a direction away from the bottom surface.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF PREFERRED EMBODIMENT

The following describes a color printer (hereinafter, "printer") as an embodiment of an image forming device and a power line retaining member pertaining to the present invention.

(1) Printer Configuration

Figure 1:
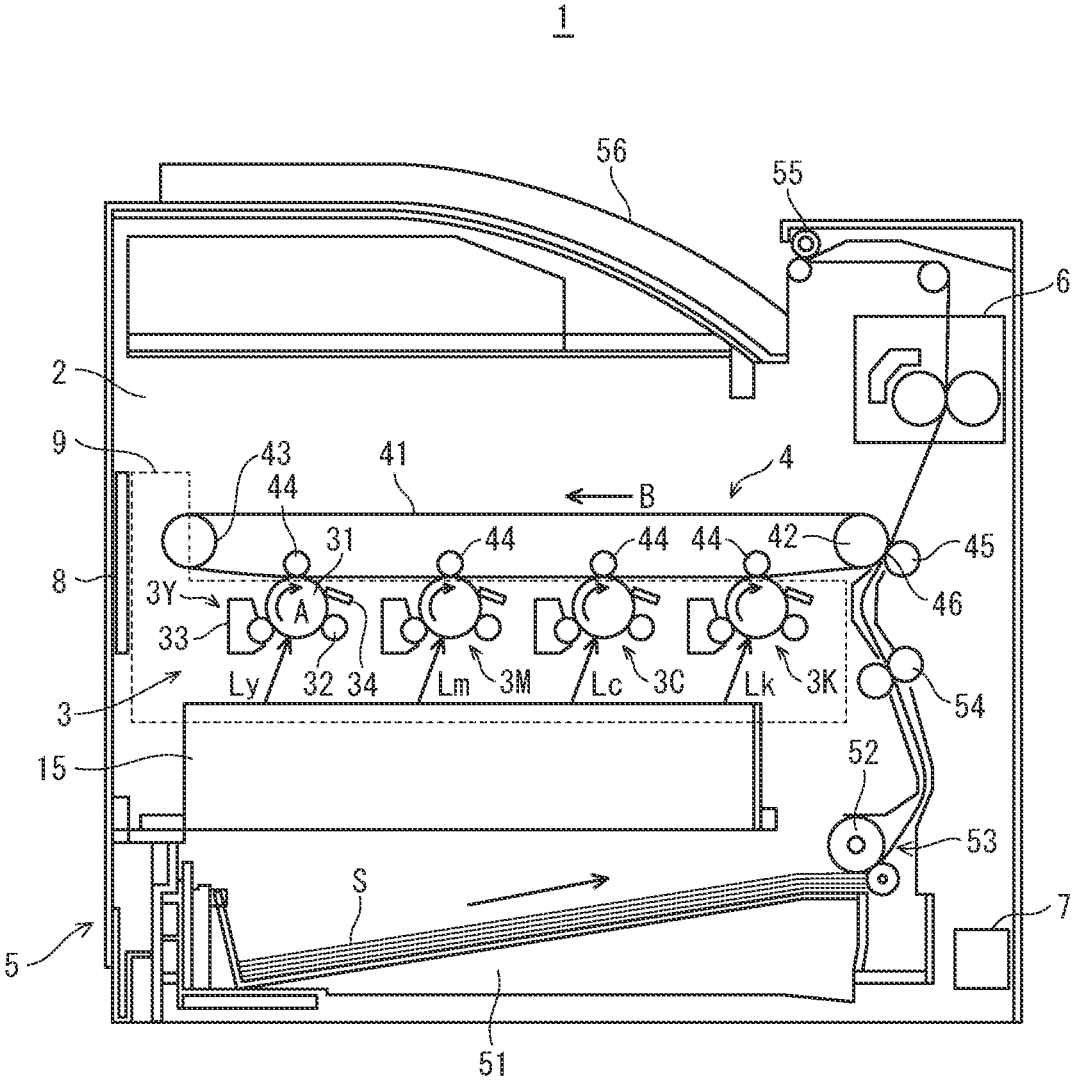
FIG. 1 illustrates a printer pertaining to an embodiment.

FIG. 1 is a schematic frontal view illustrating a printer 1 pertaining to the embodiment.

As shown in FIG. 1, the printer 1 includes an image forming unit 3, an intermediate transfer unit 4, a feeder unit 5, a fixing unit 6, a controller 7, and a high voltage power supply board 8.

The printer 1 is connected to a network (for example, a LAN) and, upon receiving an instruction to execute a print job from an external terminal device (not illustrated), creates, based on the instruction, toner images from yellow, magenta, cyan, and black toner, and transfers the toner images to a sheet to create a color image. Yellow, magenta, cyan, and black reproduced colors are referred to by the letters Y, M, C, and K and these letters are added to the reference signs of related elements of the printer 1.

The image forming unit 3 is disposed centrally in a device body 2 when viewed from the device front, and includes imaging units 3Y, 3M, 3C, 3K and an exposure unit 15.

The imaging unit 3Y includes a photoreceptor drum 31 that rotates in the direction indicated by the arrow A, and in the vicinity thereof a charger 32, a developing unit 33, and a cleaner 34 for cleaning the photoreceptor drum 31. A yellow toner image is formed on the photoreceptor drum 31. Here, a configuration is described that uses the photoreceptor drum 31 as an image carrier, but this is just an example and a photoreceptor belt may be used, for example.

Other imaging units 3M, 3C, 3K have the same basic configuration as the imaging unit 3Y, and form toner images of their corresponding colors on their respective photoreceptor drums. Reference signs are not shown here for the elements of the imaging units 3M, 3C, 3K.

The intermediate transfer unit 4 is disposed above the imaging units 3Y, 3M, 3C, 3K, and includes an intermediate transfer belt 41, a drive roller 42, a driven roller 43, primary transfer rollers 44, and a secondary transfer roller 45.

The intermediate transfer belt 41 is looped around, tensioned by, and driven in a circumferential direction indicated by the arrow B by the drive roller 42, the driven roller 43, and the primary transfer rollers 44.

The primary transfer rollers 44 are disposed opposite the photoreceptor drums 31 of the imaging units 3Y, 3M, 3C, 3K with the intermediate transfer belt 41 therebetween. The secondary transfer roller 45 is disposed opposite the drive roller 42 with the intermediate transfer belt 41 therebetween.

The exposure unit 15 is disposed below the imaging units 3Y, 3M, 3C, 3K. Light-emitting elements of the exposure unit 15 emit light beams Ly, Lm, Lc, Lk due to drive signals from the controller 7, in order to irradiate and expose the photoreceptor drums 31 that are charged by their respective chargers 32, for image forming in Y, M, C, K colors. According to this exposure, an electrostatic latent image is formed on each of the photoreceptor drums 31 of the imaging units 3Y, 3M, 3C, 3K.

For each of the imaging units 3Y, 3M, 3C, 3K the electrostatic latent image formed on the photoreceptor drum 31 is developed by developer of the developing unit 33, for example toner, to form a toner image of a corresponding color on the photoreceptor drum 31.

For each of the photoreceptor drums 31, the toner image formed thereon is transferred onto the intermediate transfer belt 41 by a corresponding one of the primary transfer rollers 44 opposite the photoreceptor drum 31 that sandwiches the intermediate transfer belt 41. When performing this transfer, a control is executed to stagger toner image formation timing for the imaging units 3M, 3C, 3K by predefined amounts from the toner image formation of the imaging unit 3Y, thereby overlaying each color of toner image on the same position on the intermediate transfer belt 41. Thus, a color toner image is formed on the intermediate transfer belt 41.

The feeder unit 5 includes a paper cassette 51 that houses sheets, a feeding roller 52 that feeds a sheet S from the paper cassette 51 to a transport path 53 one sheet at a time, and a timing roller 54 that transports the sheet S to a secondary transfer location 46, where the secondary transfer roller 45 contacts the intermediate transfer belt 41, controlling the timing at which the sheet S arrives at the secondary transfer location 46.

The timing roller 54 transports the sheet S to the secondary transfer location 46 in accordance with a timing at which the overlaid color toner image is transported to the secondary transfer location 46 on the intermediate transfer belt 41. When the sheet S passes through the secondary transfer position 46, the overlaid color toner image on the intermediate transfer belt 41 is transferred collectively onto the sheet S by using the secondary transfer roller 45. The sheet S onto which the overlaid color toner image is transferred is transported to the fixing unit 6.

The fixing unit 6 is disposed above the intermediate transfer unit 4 and fixes the overlaid color toner image (unfixed image) on the sheet S that is transported from the secondary transfer roller 45, by application of heat and pressure. The sheet S that passes through the fixing unit 6 is ejected onto an output tray 56 by an output roller 55.

The high voltage power supply board 8 is disposed to a left side of the device body 2 viewed from the device front, and converts DC or AC from a commercial power supply to a predefined high voltage, then outputting voltage to the chargers 32 and the developing units 33 of the imaging units 3Y, 3M, 3C, 3K.

In the present embodiment, a charger bias voltage required for charging, for example −1 kV to −2 kV DC, is outputted to the charger 32, and a developer bias voltage required for developing, for example −300 V to −500 V DC, is outputted to the developing unit 33.

In the printer 1 there are four of the chargers 32 and four of the developing units 33 for the four of the imaging units 3Y, 3M, 3C, 3K. The high voltage power supply board 8 has a total of eight output terminals corresponding to the chargers 32 and the developing units 33. For each of the chargers 32 and the developing units 33, a bias voltage is supplied from a corresponding one of the output terminals via a power supply line.

Each power supply line is made from three metal wires (bare wires) electrically connected in series without an insulating coating. A total of eight of the power supply lines correspond to the four chargers 32 and the four developing units 33. Configuration of each of the power supply lines is described later.

A power line retaining member 9 (indicated by a dashed line) for holding a plurality of power supply lines is disposed further towards the device rear than the imaging units 3Y, 3M, 3C, 3K. The power line retaining member 9 is formed by an electrically insulative material, here a resin, into a plate shape.

For each power supply line, the power line retaining member 9 has a guide groove (described later) for holding the power supply line, into which the power supply line is fitted. In this way shorts caused by the bare wires of the power supply lines contacting a frame of the device body 2, for example, are prevented.

(2) Controller Configuration

Figure 2:
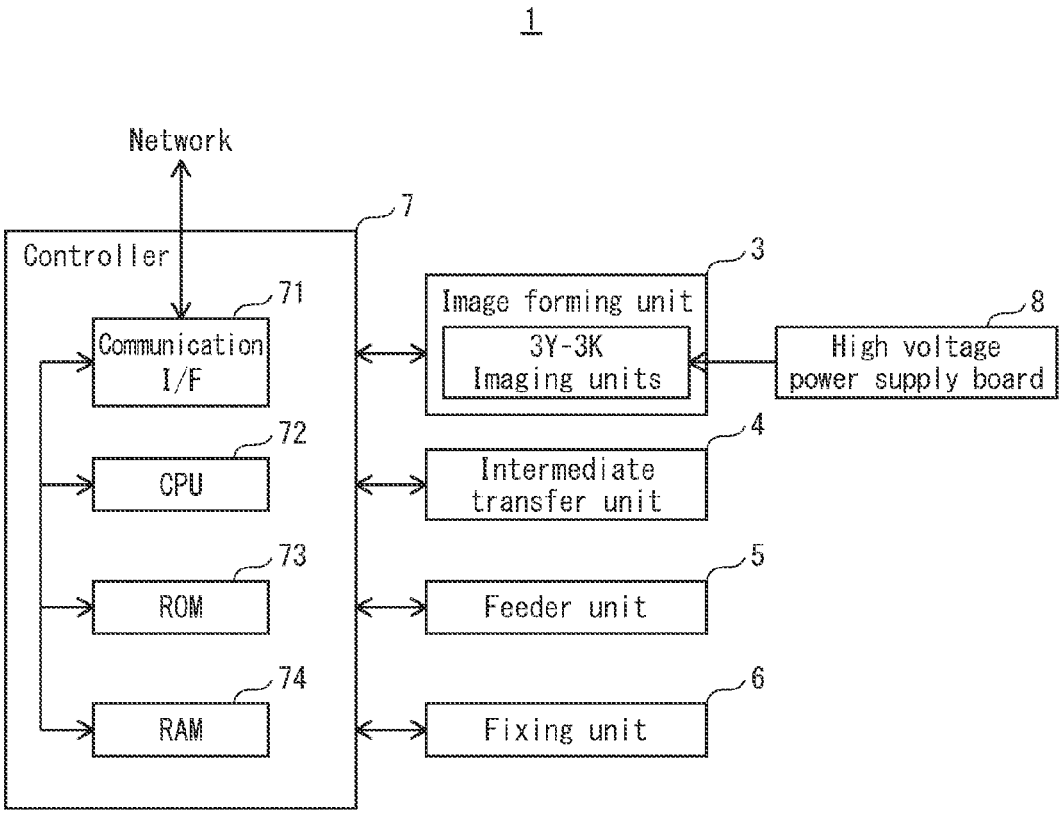
FIG. 2 is a block diagram illustrating a controller disposed in a printer.

FIG. 2 is a block diagram illustrating the controller 7.

As illustrated in FIG. 2 the controller 7 includes a communication interface (I/F) 71, a CPU 72, a ROM 73, and a RAM 74, which can communicate with each other.

The communication I/F 71 is an interface for connecting to a network such as a LAN, such as a LAN card or LAN board, and communicates with an external terminal connected via the network.

The CPU 72 reads a required program from the ROM 73, and controls the image forming unit 3, the intermediate transfer unit 4, the feeder unit 5, and the fixing unit 6 to smoothly execute print jobs. The RAM 74 is used as a work area of the CPU 72.

The charger bias voltage and the developer bias voltage outputted from the high voltage power supply board 8 are inputted to the imaging units 3Y, 3M, 3C, 3K. According to reception of the charger bias voltage, the charger 32 charges a surface of the photoreceptor drum 31 by a predefined potential. According to reception of the developer bias voltage, the developing unit 33 develops an electrostatic latent image on the photoreceptor drum 31 by using toner to visualize the electrostatic latent image.

Figure 3:
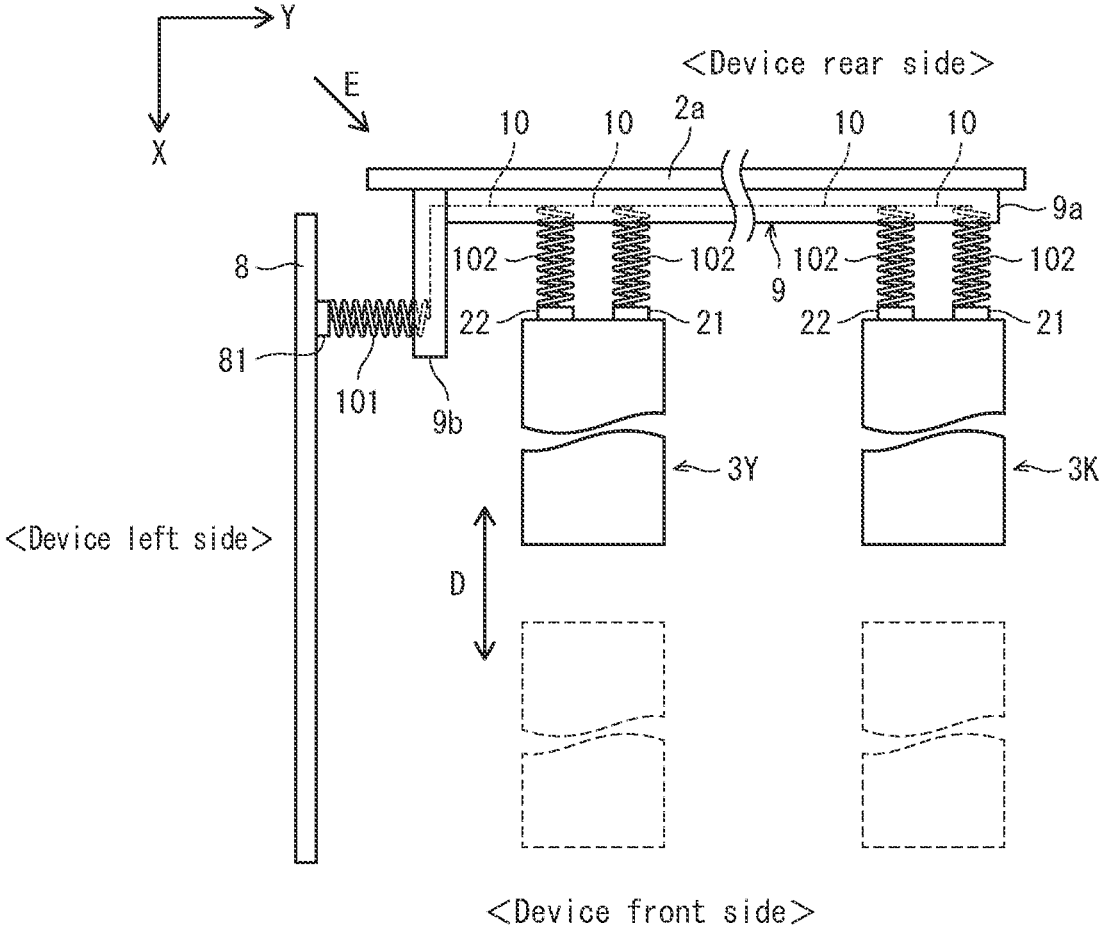
FIG. 3 is a schematic plan view illustrating imaging units, a high-voltage power supply board, a power line retaining member to which multiple power supply lines are attached, and positional relationships thereof.

(3) Positional Relationship of Imaging Units, High Voltage Power Supply Board, and Power Lines FIG. 3 is a plan view schematic diagram from above the printer 1, illustrating a positional relationship between the imaging units 3Y, 3K, the high voltage power supply 8, the power line retaining member 9, and power supply lines 10. The imaging units 3M, 3C are not shown. In FIG. 3, a front-back device direction is indicated as an X axis and a left-right device direction is indicated as a Y axis.

As illustrated in FIG. 3, the power line retaining member 9 is attached to a frame 2*a* of the rear side of the device and includes a first retaining board 9*a* elongated in the left-right device direction (Y-axis direction) and a second retaining board 9*b* elongated in the X-axis direction from a device left-side end of the first retaining board 9*a* towards the device front side.

Each of the power supply lines 10 (dashed lines), is held across the first retaining board 9*a* and the second retaining board 9*b* of the power line retaining member 9.

A reception terminal 21 of the charger 32 and a reception terminal 22 of the developer 33 are exposed on the device rear side of the imaging unit 3Y. A contact portion 102 of an end of one of the power supply lines 10 is electrically connected to the reception terminal 21 of the charger 32 and a contact portion 102 of an end of another one of the power supply lines 10 is electrically connected to the reception terminal 22 of the developing unit 33. Each of the contact portions 102 is a coil spring and the elastic bias thereof maintains contact with the reception terminal 21 or the reception terminal 22.

Similarly, for each of the other imaging units 3M, 3C, 3K, a reception terminal 21 of the charger 32 is electrically connected to a contact portion 102 of an end of a power supply line 10 and a reception terminal 22 of the developing unit 33 is electrically connected to a contact portion 102 of an end of a power supply line 10.

Each of the imaging units 3Y, 3M, 3C, 3K is supported by and can be inserted into and removed from a slot (not illustrated) in the device body 2 in the device front-back direction D along the X-axis. A user can, for example, remove the imaging unit 3Y from a slot by pulling it from the device body 2 from the device front direction, and attach a new imaging unit 3Y to the device body 2 by pushing it into the slot in the device rear direction. According to this attachment, the reception terminals 21, 22 of the imaging unit 3Y are connected to the contact portions 102 of the corresponding power supply lines 10. This is similar for the other imaging units 3M, 3C, 3K.

Contact portions 101 of the other ends of the power supply lines 10 are electrically connected to output terminals 81 of the high voltage power supply board 8. Similarly to the contact portions 102, the contact portions 101 are coil springs and the elastic bias thereof maintains contact with the output terminals 81. The high voltage power supply board 8 has a total of eight of the output terminals 81, but they are arranged up and down with intervals therebetween and therefore only the uppermost one of the output terminals 81 is visible in FIG. 3.

(4) Power Line Retaining Member Configuration

Figure 4:
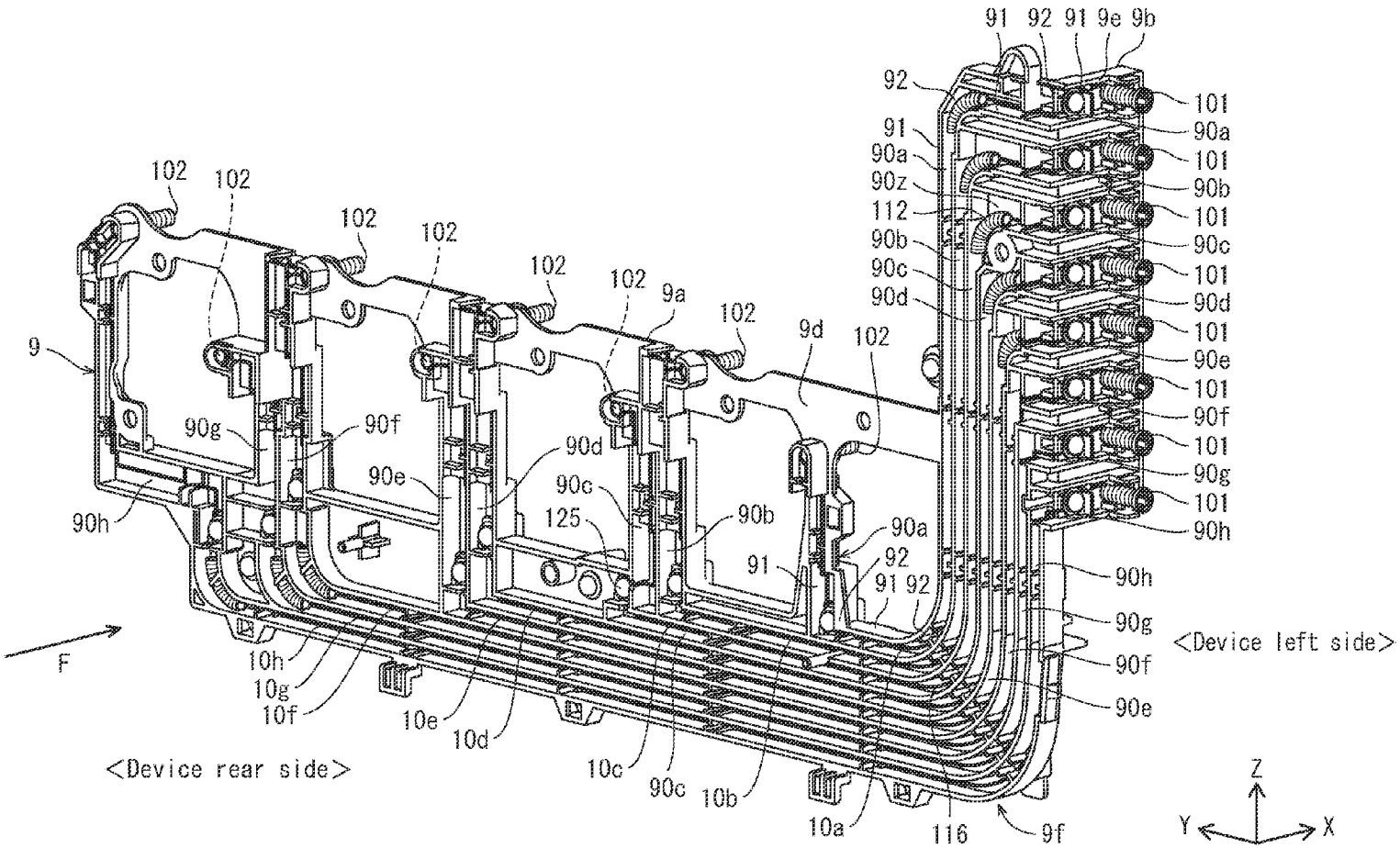
FIG. 4 is a perspective view of the power line retaining member viewed from the direction of the arrow E in FIG. 3.
Figure 5:
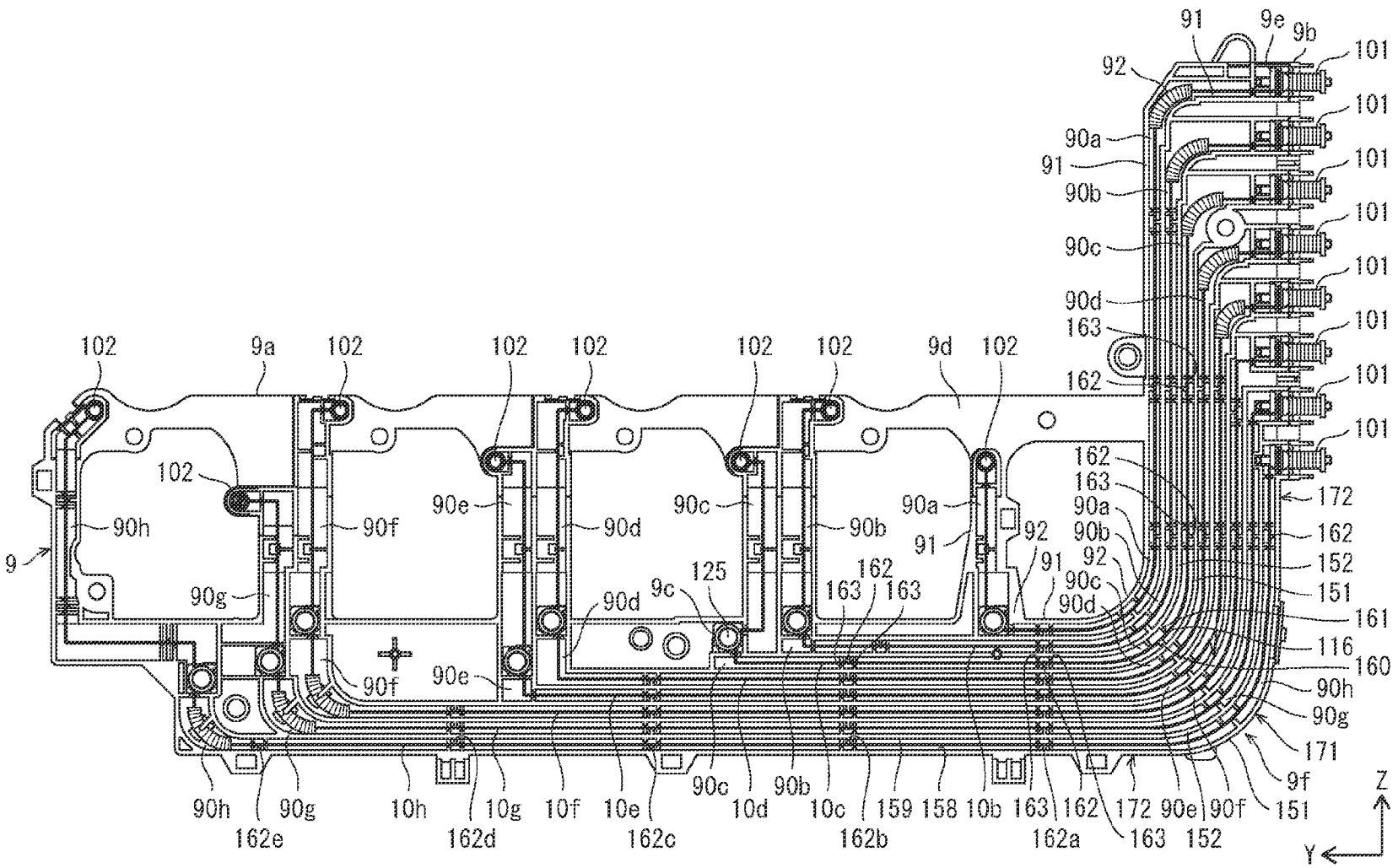
FIG. 5 is a rear view of the power line retaining member viewed from the direction of the arrow F in FIG. 4.

FIG. 4 is a perspective view of the power line retaining member 9 viewed from the direction indicated by the arrow E in FIG. 3. FIG. 5 is a rear view of the power line retaining member 9 viewed from the direction indicated by the arrow F in FIG. 4. Both FIG. 4 and FIG. 5 illustrate states of the power line retaining member 9 with eight of the power supply lines 10 attached thereto.

In FIG. 4 and FIG. 5, the eight of the power supply lines 10 are assigned reference signs 10*a* to 10*h* to distinguish them from each other, and the imaging units 3Y, 3M, 3C, 3K, the high voltage power supply board 8, and the frame 2*a* are not illustrated. Further, the vertical direction is indicated by a Z-axis.

As indicated in FIG. 4 and FIG. 5, the first retaining board 9*a* of the power line retaining member 9 is a plate-like member aligned with the Y-Z axes, the second retaining board 9*b* is a plate-like member aligned with the X-Z axes, and eight guide grooves 90*a* to 90*h* are formed on a surface 9*d* of the device rear side of the first retaining board 9*a* and a surface 9*e* of the device left side of the second retaining board 9*b*.

Each of the guide grooves 90*a* to 90*h* houses one of the power supply lines 10*a* to 10*h* that has been assigned a matching alphabet reference letter.

(5) Power Supply Line Configuration

Figure 6:
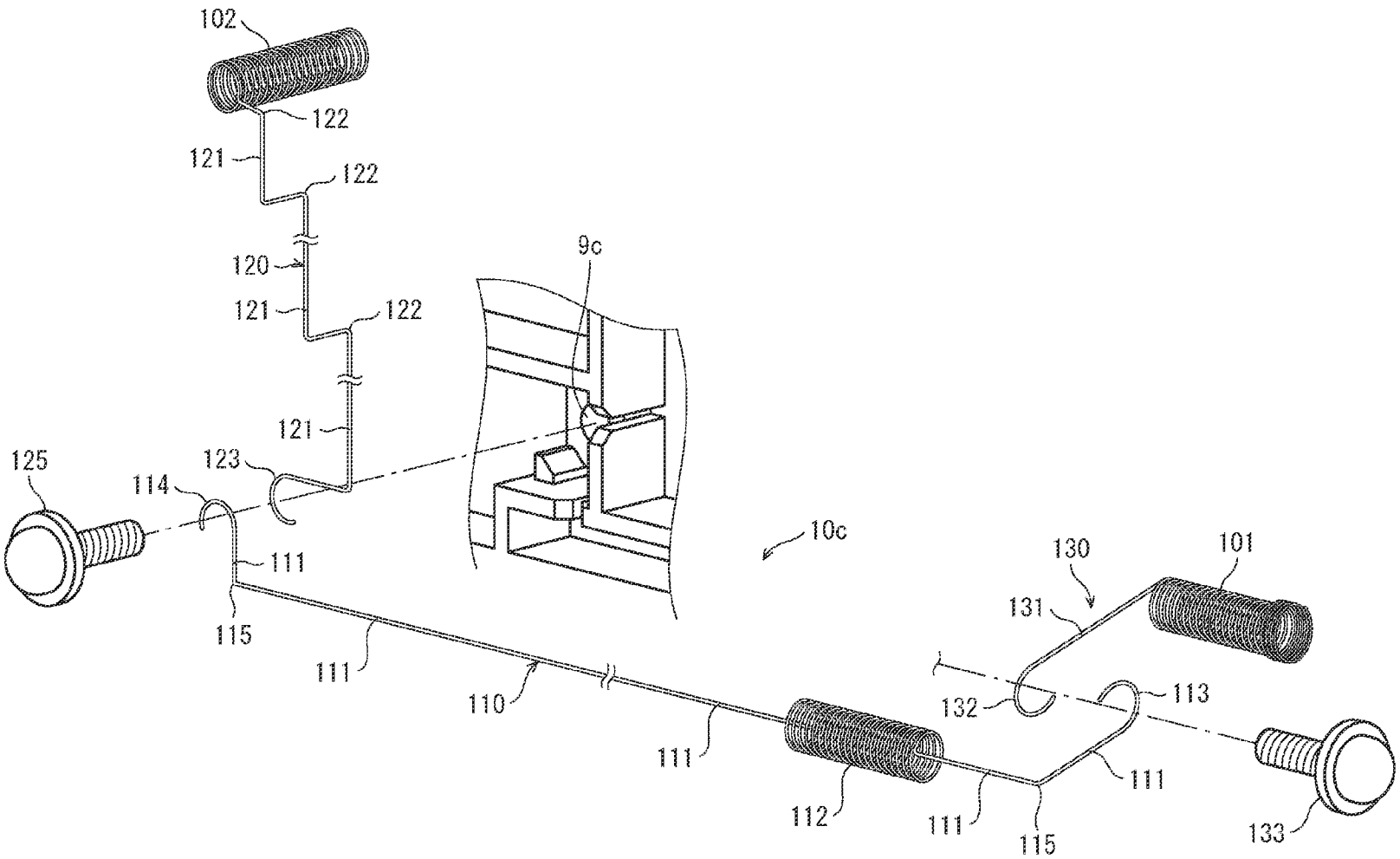
FIG. 6 is a perspective view illustrating a state in which power lines are removed from the power line retaining member.

FIG. 6 is a perspective view illustrating the power supply line 10*c* removed from the power line retaining member 9, in which the power supply line 10*c* is shown in a natural (not deformed) state with no external forces applied to it.

As shown in FIG. 6 the power supply line 10*c* includes a power line 110, a power line 120, and a power line 130, each made of a metallic electrically conductive wire material. Each of the power lines 110, 120, 130 is a single bare wire that is not insulated and is subjected to a bending process, and is stainless steel, of a grade such as SUS301, a thickness of which may be 0.1 mm to 1.0 mm, for example. Of course the material of the power lines is not limited to SUS, and other materials such as hard steel wire, piano wire, and oil-tempered wire may be used.

Each end in a length direction of the power line 110 is a hook-shaped connection terminal 113, 114, and between the ends are straight portions 111, a portion to be bent 112, and bent portions 115.

The straight portions 111 are each straight stainless steel bare wire portions that are not processed in any way. A portion 116 (FIG. 4, FIG. 7) of one of the straight portions 111 is elastically deformed into a bent shape when housed in the guide groove 90*c*, as described later.

The portion to be bent 112 is a straight stainless steel bare wire portion that is subjected to a coiling process of winding into a spiral in the length direction to form a tensile coil spring of predefined average coil diameter and pitch.

The portion to be bent 112 has straight portions 111 at either end in the length direction of the power line 110 and the portion to be bent 112 and the straight portions 111 at either end form a continuous straight shape that extends in the length direction when not subjected to any external force. In other words, the portion to be bent 112 is coiled so an axial center of the coil spring forms a straight line with the straight portions 111 at either end.

The bent portions 115 are each stainless steel bare wire portions that are subjected to a bending process to be bent into substantially right angles. The portion to be bent 112 and the bent portions 115, like the portion 116 of the straight portion 111, are each housed in bent grooves 92 (FIG. 4) of the power line retaining member 9.

One end in a length direction of the power line 120 is a hook-shaped connection terminal 123, the other end in the length direction is a contact portion 102, and between the ends are straight portions 121 and bent portions 122.

The straight portions 121 are each straight stainless steel bare wire portions that are not processed in any way. The bent portions 122 are each stainless steel bare wire portions that are subjected to a bending process to be bent into substantially right angles.

The contact portion 102 is a portion connected to a reception terminal of the developing unit 33 of the imaging unit 3M that receives a developer bias voltage, and is subjected to similar processing as the portion to be bent 112.

The connection terminal 123 is fixed by a screw 125 into a screw hole 9*c* in the guide groove 90*c* of the power line retaining member 9, while overlapping with the connection terminal 114 of an end of the power line 110. According to this fixing, the power line 110 and the power line 120 are electrically connected.

One end in a length direction of a straight portion 131 of the power line 130 is a hook-shaped connection terminal 132, the other end in the length direction is a contact portion 101.

The contact portion 101 is a portion connected to an output terminal of the high voltage power supply board 8 that outputs a developer bias voltage for the color M, and is subjected to similar processing as the portion to be bent 112.

The connection terminal 132 is fixed by a screw 133 into a screw hole (not illustrated) in the guide groove 90*c* of the power line retaining member 9, while overlapping with the connection terminal 113 of an end of the power line 110. According to this fixing, the power line 110 and the power line 130 are electrically connected. Thus, the power lines 110, 120, 130 are serially connected to form a single power supply line 10*c*.

Figure 7:
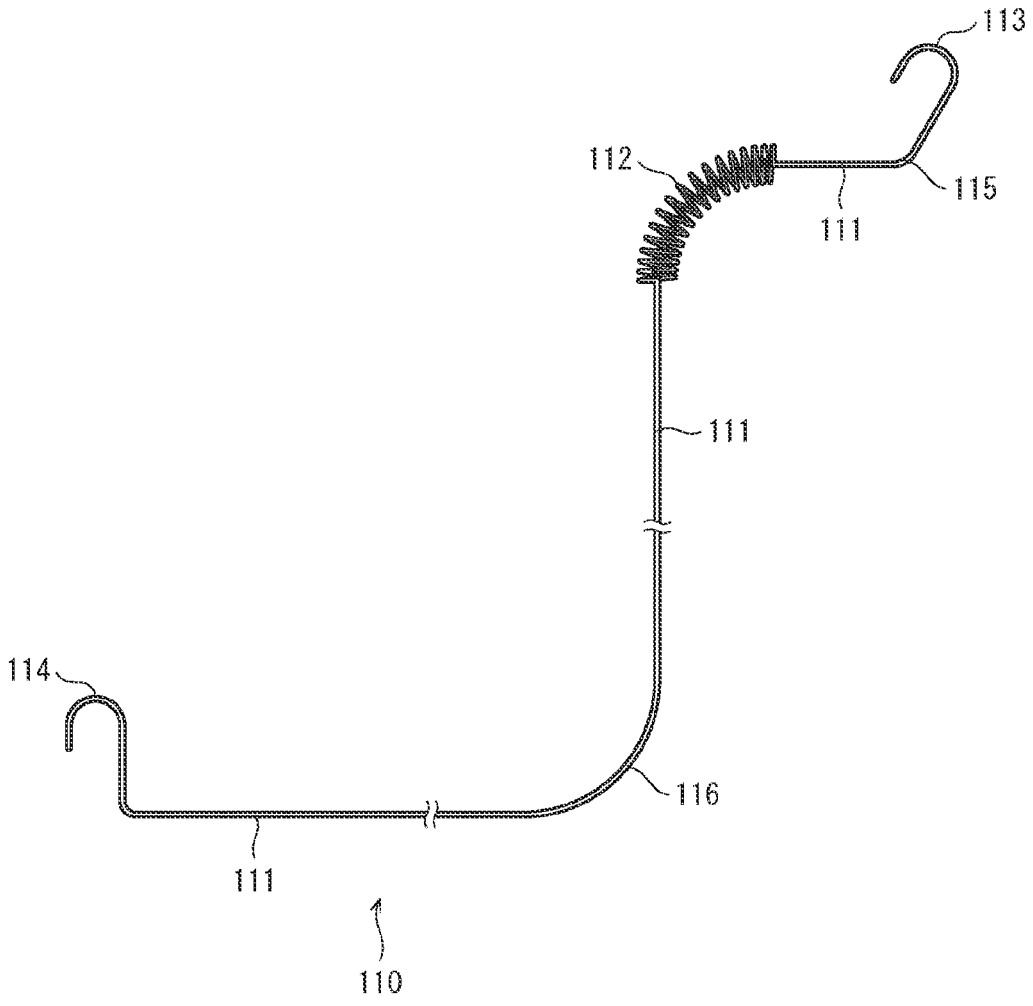
FIG. 7 is a perspective view illustrating alignment of a power line as if attached to the power line retaining member.

FIG. 7 is a perspective view illustrating alignment of the power line 110 as if it were attached to the power line retaining member 9. In contrast to the alignment shown in FIG. 6 prior to attachment, the portion 116 of the straight portion 111 and the portion to be bent 112 (portion in the form of a coil spring) are shown in states of being held in the power line retaining member 9, elastically deformed to be bent at substantially a right angle. In this way, the portion 116 of the power line 110 can also be referred to as a portion to be bent.

The other power supply lines 10*a*, 10*b*, and 10*d* to 10*h* are essentially similar to the power supply line 10*c* although positions at which the portion to be bent 112 is formed are different. In the following, when a distinction between the power supply lines 10*a* to 10*h* is not required, they are referred to as the power supply line(s) 10, and when a distinction between the guide grooves 90*a* to 90*h* is not required, they are referred to as the guide groove(s) 90.

Returning to FIG. 4, the uppermost guide groove 90*a* includes straight grooves 91 and bent grooves 92 that alternate along the length direction of the guide groove 90*a* from one end to the other. The other guide grooves 90*b* to 90*h* are similar.

For each of the guide grooves 90, position and curvature of each of the bent grooves 92 and length of each of the straight grooves 91 differs, and therefore, according to shape and position of the bent grooves 92 and the straight grooves 91, length, shape, and position of the straight portions and the bent portions of the power lines 110, 120, 130 that make up the power supply lines 10 housed in the guide grooves 90 are pre-planned, and each power line is manufactured based on this pre-planning.

Here, assuming the power line 110 shown in FIG. 7 is the power line 110 of the power supply line 10*c*, the portion 116 of the straight portion 111 of the power line 110 is in a bent alignment housed in the groove of a corner portion 9*f* of the guide groove 90*c*, and the portion to be bent 112, which is a coil spring, is in a bent alignment housed in a bent groove 90*z* of an upper portion of the guide groove 90*c*, as shown in FIG. 4. Other power lines are similarly bent.

The contact portions 101, which are ends of the power supply lines 10, are arranged in the vertical direction with intervals therebetween when housed in corresponding ones of the guide grooves 90. The output terminals 81 of the high voltage power supply board 8, which are not illustrated, are also arranged in the vertical direction with intervals therebetween. Positions of the contact portions 101 and the output terminals 81 in the vertical direction are predefined to ensure that the contact portions 101 and the output terminals 81 are paired together with each other in the order they are arranged in.

The contact portions 102, which are the other ends of the power supply lines 10, pass through holes (not illustrated) in the first retaining board 9*a* of the power line retaining member 9, the ends protruding to the device front side direction. Thus, the reception terminals 21, 22 of the imaging units 3Y, 3M, 3C, 3K, which are disposed further towards the device front side than the power line retaining member 9, are connected to corresponding ones of the contact portions 102 of the power supply lines 10.

In this connected state, in order that restoring force of the coil springs of the contact portions 102 through the holes of the first retaining board 9*a* does not cause the contact portions 102 to lift out of the guide grooves 90 in the device rear direction, the contact portions 102 are fixed to the first retaining board 9*a* by means such as adhesion.

For each of the power supply lines 10, the contact portion 101 of one end is a voltage input terminal and the contact portion 102 of the other end is a voltage output terminal. Here, the total number of coils and the average coil radius are the same for the coil springs of the contact portions 101 of each of the power supply lines 10. This is also true for the contact portions 102.

During assembly, when manufacturing the printer 1, a worker fits the power lines 110, 120, 130 of the power supply lines 10 into the guide grooves 90 of the power line retaining member 9. This work includes fixing the power lines 110, 120, 130 by using the screws 125, 133 shown in FIG. 6, and fixing the contact portions 102 of the power lines 120 to the power line retaining member 9.

The power lines 120 are fixed to the power line retaining member 9 at the connection terminals 123 and the contact portions 102. The power lines 130 are fixed to the power line retaining member 9 at the connection terminals 132. Thus, even if, for example, mechanical vibrations are propagated to the power lines 120, 130, there is no risk of the mechanical vibrations lifting the power lines 120, 130 out of the guide grooves 90 after the work of housing them in the guide grooves 90 is complete. The mechanical vibrations in this example may be caused after delivery to a user by driving of a rotary member such as the photoreceptor drum 31 and the intermediate transfer belt 41 during a print job executed by the printer 1.

On the other hand, the power lines 110 are considerably longer than the power lines 120, 130, so even when the connection terminals 113, 114 are fixed at both ends by the screws 125, 133, there is a risk of central portions of the power lines 110 rising out of the guide grooves 90 due to the mechanical vibrations described above. A configuration that requires attachment of a separate retaining member that prevents this lifting in addition to the power line retaining member 9 would lead to a reduction in ease of assembly during manufacture.

According to the present embodiment, lifting of the power lines 110 is prevented without attachment of a separate retaining member, by shapes of side walls of the guide grooves 90 of the power line retaining member 9. The following describes specifics of the configuration of the side walls of the guide grooves 90, with reference to FIG. 8, FIGS. 9A-9B, and FIG. 10.

(6) Power Line Lifting Prevention Mechanism

Figure 8:
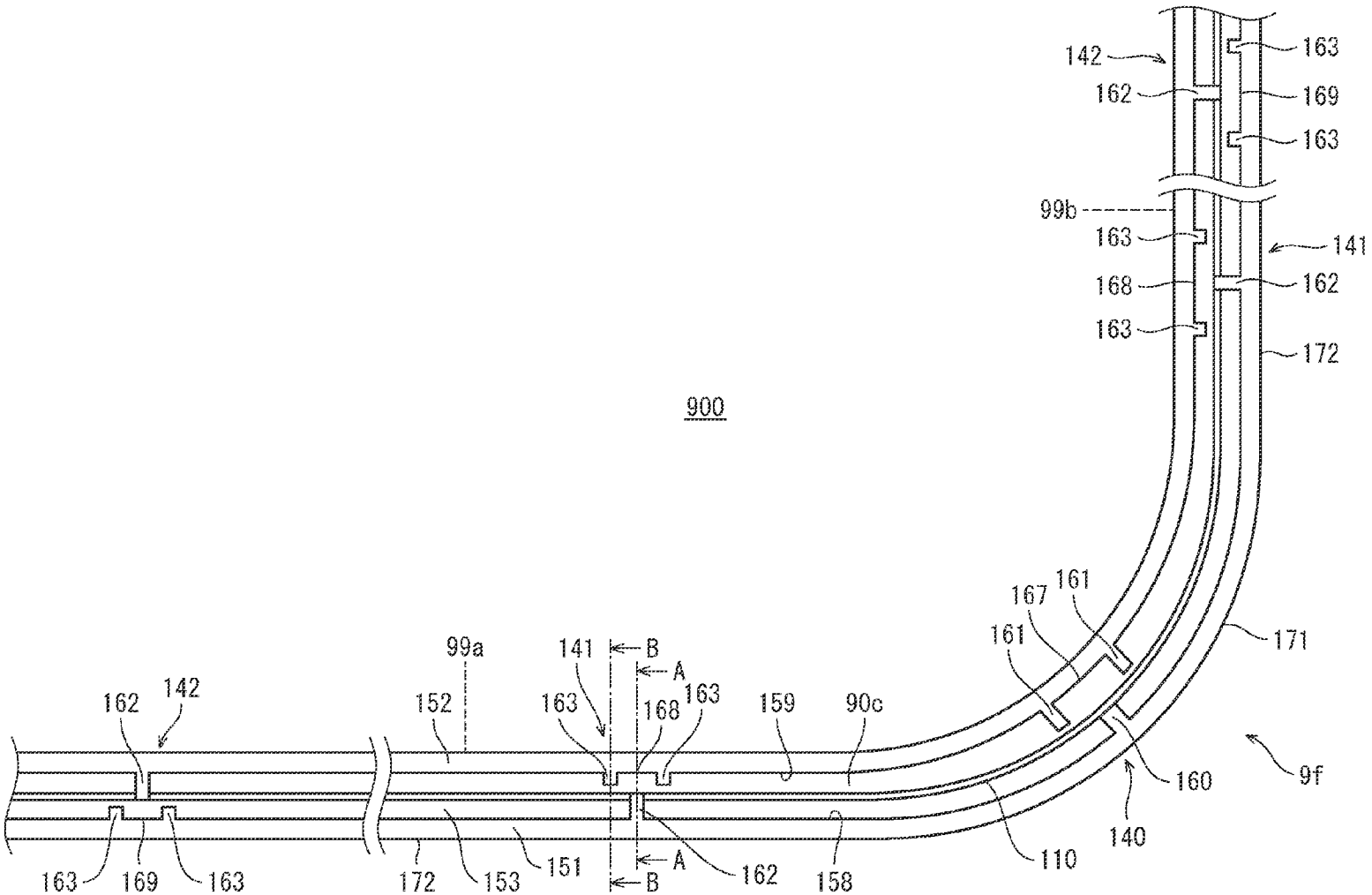
FIG. 8 is an enlargement of a groove at a corner portion of the power line retaining member shown in FIG. 5, viewed from the rear of the device.

FIG. 8 is an enlargement of the guide groove 90*c* when the corner portion 9*f* of the power line retaining member 9 shown in FIG. 5 is viewed from the rear of the device. Other guide grooves 90*a*, 90*b*, and 90*d* to 90*h* are not shown. Hereinafter, a length direction of the guide groove 90*c* is referred to as a "groove length direction" and a width direction of the guide groove 90*c* is referred to as a "groove width direction".

As illustrated in FIG. 8, a guide 900 has side walls 151, 152 standing upright at both sides of the groove width direction of a bottom surface 153, the side walls 151, 152 and the bottom surface 153 defining the guide groove 90*c*. Opposing faces of the side wall 151 and the side wall 152 are referred to as an internal wall surface 158 and an internal wall surface 159, respectively. The internal wall surfaces 158, 159 are perpendicular to the bottom surface 153.

A portion of the corner portion 9*f* of the guide groove 90*c* is a curved groove 171 (first groove portion) that has a predefined curvature, and at both ends of the curved groove 171 in the groove length direction are straight grooves 172 (second groove portions) that are straight and are continuous with the curved groove 171.

The curved groove 171 and the straight grooves 172 are provided with positioning portions 140, 141, 142 for determining position, in the groove width direction, of the power line 110 housed in the guide groove 90*c*.

The positioning portion 140 of the curved groove 171 includes a protrusion 160 on the internal wall surface 158 of the side wall 151 and two protrusions 161 on the internal wall surface 159 of the side wall 152.

The protrusion 160 is disposed substantially centrally in the groove length direction of the curved groove 171, and the two protrusions 161 are disposed on the internal wall surface 159 equal distances in both directions along the groove length direction from a position 167 opposite the protrusion 160. The protrusion 160 and the protrusions 161 are the same shape as each other, and ends thereof in the groove width direction (surfaces that face the power line 110) are perpendicular to the bottom surface 153.

For each of the straight grooves 172, a positioning portion 141 and a positioning portion 142 are disposed in that order in increasing distance from the positioning portion 140 of the curved groove 171.

The positioning portion 141 includes a protrusion 162 on the internal wall surface 158 of the side wall 151 and two protrusions 163 on the internal wall surface 159 of the side wall 152. With respect to the protrusion 162, the two protrusions 163 are disposed on the internal wall surface 159 equal distances in both directions along the groove length direction from a position 168 opposite the protrusion 162.

The positioning portion 142 includes two protrusions 163 on the internal wall surface 158 of the side wall 151 and a protrusion 162 on the internal wall surface 159 of the side wall 152. With respect to the protrusion 162, the two protrusions 163 are disposed on the internal wall surface 158 equal distances in both directions along the groove length direction from a position 169 opposite the protrusion 162.

The protrusions 162 of the positioning portions 141, 142 are the same shape as each other, and the protrusions 163 of the positioning portions 141, 142 are the same shape as each other, but different from the protrusions 162, as described later.

Thus, for each of the positioning portions 140, 141, 142, the internal wall surface of a side wall has one protrusion, the internal wall surface of the other side wall has two protrusions, and the one protrusion is disposed between the two protrusions in the groove length direction.

Thus, when the power line 110 is housed in the guide groove 90*c*, the power line 110 is between the protrusions on both sides of the groove width direction at the location of the positioning portions, preventing the power line 110 from shifting greatly in the groove width direction and stably housing the power line 110 in a position substantially central in the groove width direction.

The protrusions 162 of the positioning portions 141, 142 function as restricting portions that restrict lifting of the power line 110 housed in the guide groove 90*c*.

Figure 9A:
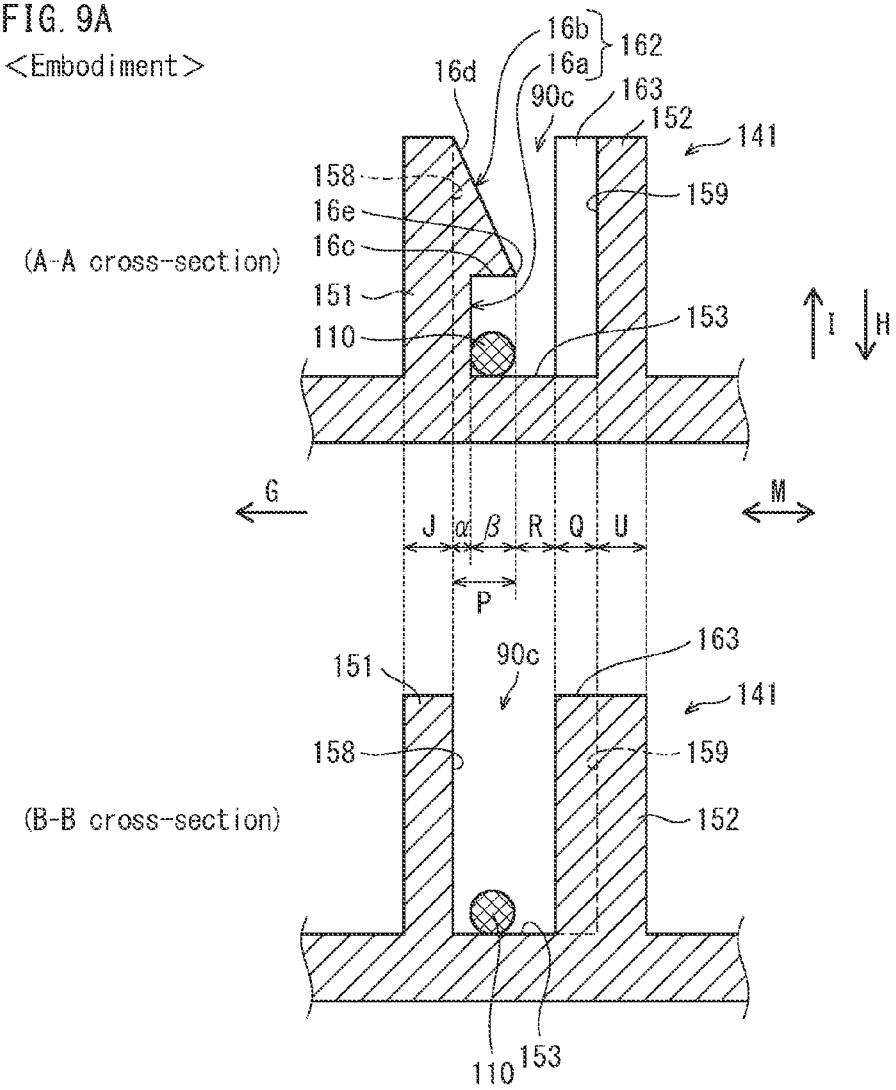
FIG. 9A includes cross-sectional views of projecting portions of a positioning unit pertaining to the embodiment shown in FIG. 8, taken along the line A-A and the line B-B shown in FIG. 9A.

FIG. 9A includes a cross-section of the protrusion 162 along a line A-A and a cross-section of the protrusion 163 along a line B-B of the positioning portion 141 shown in FIG. 8. In FIG. 9A, a direction indicated by an arrow M corresponds to the groove width direction, a direction indicated by an arrow H corresponds to a direction towards the bottom surface 153, and a direction indicated by an arrow I corresponds to a direction away from the bottom surface 153. Length (thickness) of the side wall 151 in the groove width direction is indicated by J and thickness of the side wall 152 is indicated by U.

As indicated by the A-A cross section in FIG. 9A, the protrusion 162 includes a base portion 16*a* (a first portion) and a projection 16*b* (a second portion) in that order along the direction I from the bottom surface 153.

The base portion 16*a* is continuous with the bottom surface 153 and protrudes from the inner wall surface 158 of the side wall 151 by a constant amount α.

The projection 16*b* is a triangle in the cross-section, an amount of protrusion from the inner wall surface 158 increasing in the direction H towards the bottom surface 153. At a position where the projection 16*b* connects to the first portion 16*a* is a step 16*c* of height β, the farthest amount of protrusion P of the projection 16*b* from the inner wall surface 158 being equal to α+β.

The protrusion 163 indicated by the B-B cross-section protrudes from the inner wall surface 159 of the side wall 152 by a constant amount Q in the groove width direction M. The amount Q remains constant for any point in the direction I along the inner wall surface 159.

When the power line 110 is housed in the guide groove 90*c*, the power line 110 is pressed against the base portion 16*a* of the protrusion 162 of the positioning portion 141. This pressure is caused by the restoring force of the elasticity (spring) of the power line 110 when housed in the curved groove 171.

In other words, the power line 110 has the straight shape of the portion 116 (see FIG. 7) when no external force is applied, and when the straight shape of the portion 116 is housed in the curved groove 171 of the guide groove 90*c* the restoring force attempts to return the power line 110 to its original shape. According to this restoring force, the power line 110 presses against the protrusions 162.

Figure 10:
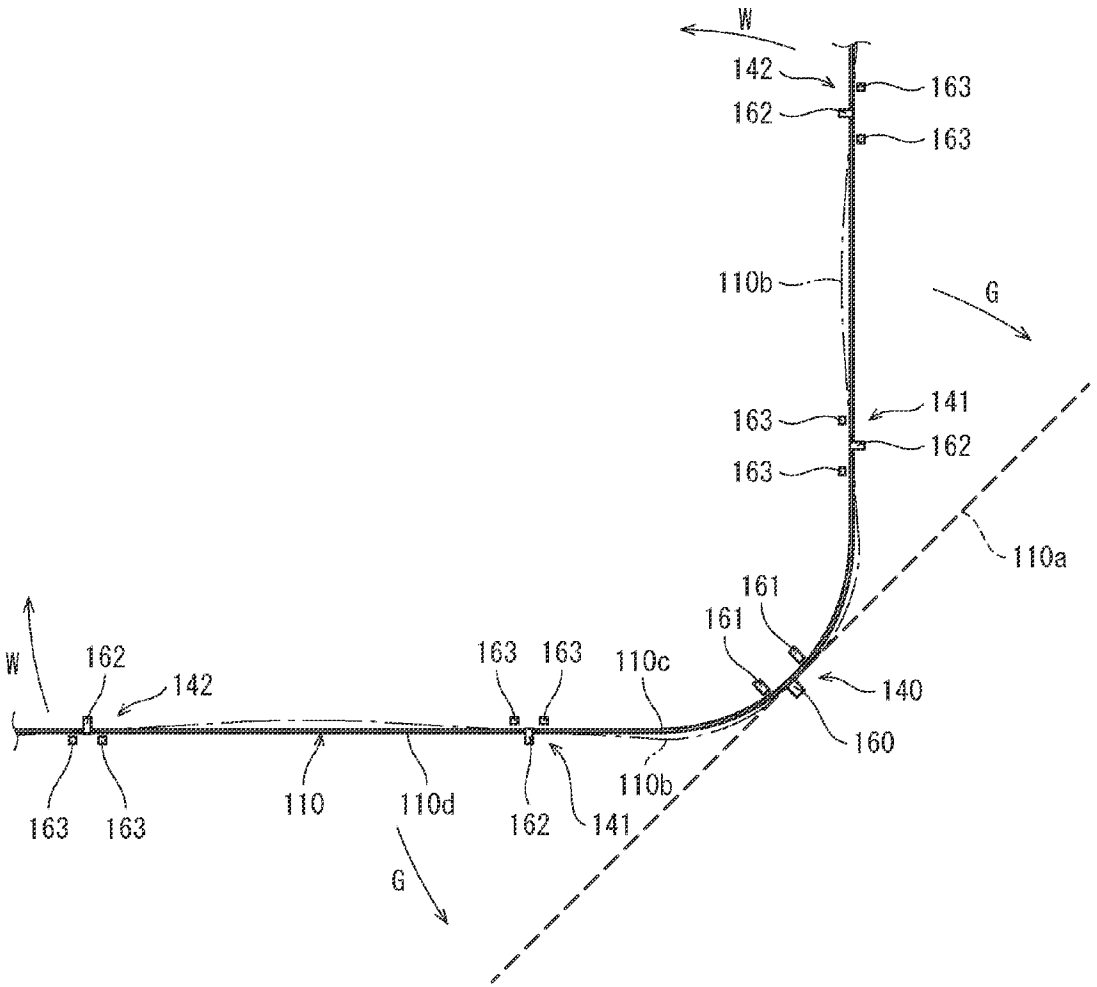
FIG. 10 is a schematic diagram illustrating a positional relationship between a power line and projecting portions.

FIG. 10 is a schematic diagram illustrating positional relationships of the power line 110 and the protrusions 160, 161, 162, 163. Bold lines indicate a curved state of the power line 110, and according to the restoring force thereof, centered on a position determined by the positioning portion 140, arrows G indicate directions by which the power line 110 attempt to return to its original straight shape, as indicated by a dashed line 110*a*.

In this way the power line 110 in the curved state, due to the restoring force thereof, pushes against the protrusions 162 of the positioning portions 141 in the direction of the arrows G. In other words, in FIG. 8, at the positioning portions 141, when the restoring force of the power line 100 in the curved state housed in the curved groove 171 attempts to return the power line 100 to its original straight shape, the side wall in the direction of return is the side wall 151 (the side wall on the outer side of the curve), which has a lesser curvature than the side wall 152.

Accordingly, at the positioning portion 141, which is closest to the positioning portion 140, which is centrally located in the length direction of the curved groove 171, the protrusion 162 on the inner wall surface 158 of the side wall 151 is pushed against by the restoring force of the power line 110 attempting to return to its original straight shape.

Returning to FIG. 9A, the power line 110, as long as the restoring force thereof is maintained, maintains a state of pushing against the base portion 16*a* of the protrusion 162 in the direction indicated by the arrow G. In other words, the base portion 16*a* of the protrusion 162 functions as a restricting portion that restricts movement of the power line 110 in the direction indicated by the arrow G.

On the other hand, when a force works on the power line 110 housed in the guide groove 90*c* to lift the power line 110 from the bottom surface 153, such as vibrations transmitted from another unit to the power line retaining member 9, when the force in the I direction is greater than a frictional force between the power line 110 and the base portion 16*a*, the power line 110 moves in the I direction while being in contact with the base portion 16*a*.

Even when such movement of the power line 110 in the I direction occurs, when the power line 110 moves as far as the step 16*c* between the base portion 16*a* and the projection 16*b*, the power line 110 does not move around the step 16*c* and is restricted from moving any further. In other words, the projection 16*b* of the protrusion 162 functions as a restricting portion that restricts movement (lifting) of the power line 110 in the direction indicated by the arrow I.

Figure 9B:
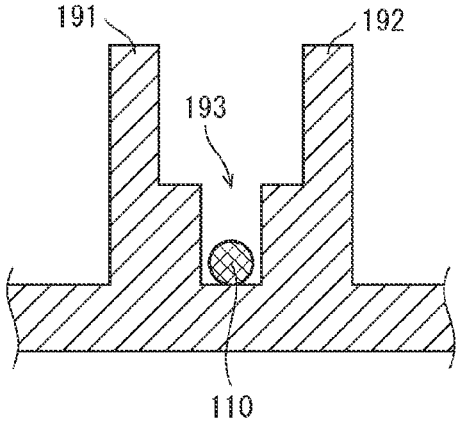
FIG. 9B illustrates a cross-section pertaining to a comparative example.

FIG. 9B is a cross-section of a guide groove of a comparative example, illustrating a narrower groove 193 between side walls 191, 192, into which the power line 110 is fitted.

This comparative example is not provided with a configuration corresponding to the projection 16*b* of the embodiment, and therefore lifting of the power line 110 from the groove 193 due to something like vibration of another unit cannot be prevented and in order to prevent lifting a separate retaining member is required.

In contrast, the embodiment indicated by the FIG. 9A is provided with the protrusion 162 that includes the base portion 16*a* and the projection 16*b*, and therefore after the power line 110 is housed in the guide groove 90*c*, lifting is prevented without requiring a separate retaining member.

During manufacturing, when work is performed to house the portion 116 of the straight shape of the power line 110 in the guide groove 90*c*, it suffices that when a worker bends the portion 116 of the straight shape to conform to the curved shape of the curved groove 171 and house the portion 116 in the curved groove 171, the power line 110 is pushed in the direction H towards the bottom surface 153 along an inclined surface 16*d* (see FIG. 9A) of the projection 16*b*.

According to this pushing, when the power line 110 moves over a tip 16*e* (see FIG. 9A) of the inclined surface 16*d* of the projection 16*b*, the restoring force of the power line 110 attempts to restore the power line 110 to its original shape by pushing in the direction G and the power line 110 contacts the base portion 16*a* and presses against it (state shown in FIG. 9A).

Accordingly, the worker simply pushes the power line 110 until it moves over the tip 16*e* of the inclined surface 16*d* of the projection 16*b*. After this pushing, according to the action of the restoring force due to the elasticity of the power line 110 and the base portion 16*a* and the projection 16*b* of the protrusion 162 on the inner wall surface 158 of the side wall 151, movement of the power line 110 is restricted in the groove width direction M and in the direction I away from the bottom surface 153.

Thus, once the power line 110 is housed in the guide groove 90*c*, it is prevented from lifting out of the guide groove 90*c*.

According to the embodiment, in order to make the work of pushing the power line 110 along the inclined surface 16*d* of the projection 16*b* easy, a gap R (see FIG. 9A) in the groove width direction between the tip 16*e* of the projection 16*b* (corresponding to a tip of the protrusion 162 in the groove width direction) and the protrusion 163 is equal to or a predefined value greater than (for example, 0.1 mm to 1 mm greater than) a diameter D of the power line 110.

Making the gap R smaller means narrowing the gap between the protrusion 162 and the protrusion 163 of the positioning portion 141 in the groove width direction M. When the gap R is smaller than the diameter D of the power line 110, the power line 110 must be forcefully pushed between the protrusion 162 and the protrusion 163 while bending the power line 110, tending to decrease workability.

On the other hand, when the gap R is too large, the protrusion 162 and the protrusion 163 of the positioning portion 141 are too far apart in the groove width direction M, and it becomes difficult to determine position of the power line 110 in the groove width direction M. Further, the width of the guide groove 90*c* is increased, increasing the size of the power line retaining member 9 when arranged alongside the guide grooves 90*a* to 90*h*.

Accordingly, the gap R is preferably as small as possible in a range in which the work of housing the power line 110 into the guide grooves 90 can easily be performed.

According to the above, only the positioning portion 141 out of the positioning portion 141 and the positioning portion 142 of the straight groove 172 is described, but the positioning portion 142 is essentially the same as the positioning portion 141 with the exception that the protrusion 161 is on the inner wall surface 159 of the side wall 152. In other words, the positioning portion 142 has a structure obtained by mirroring, left to right, the A-A cross-section and the B-B cross-section of FIG. 9A.

Thus, in the positioning portions 141 near the curved groove 171 the protrusions 161 that function as restricting portions (first restricting portions) that restrict movement of the power line 110 are on the inner wall surface 158 of the side wall 151 that corresponds to the outside of the curve, and in the positioning portions 142 farther from the curved groove 171 the protrusions 161 that serve the same function as second restricting portions are on the inner wall surface 159 of the side wall 152 that corresponds to the inside of the curve (the side wall that has a larger curvature in the curved groove 171).

In other words, the power line 110 after bending, as shown in FIG. 10, is prevented from returning to its original straight state due to contact with the protrusions 162 of the positioning portions 141, but due to the action of the restoring force of its own elasticity, a portion 110*c* of the power line 110 between the positioning portions 140 and 141, when viewed minutely, bulges slightly outwards as indicated by the dot-dash line 110*b*.

When the portion 110*c* of the power line 110 bulges outwards, a portion 110*d* between the positioning portions 141 and 142 bulges in a direction opposite the outwards bulge of the portion 110*c*, i.e. towards the inside of the curve of the curved groove 171, as indicated by the dot-dash line 110*b*.

Thus, for the power line 110 at the positioning portions 142, the restoring force thereof acts in directions indicated by the arrows W to return the power line to its original shape, i.e. opposite directions to the arrows G at the positioning portions 141, the restoring force thereby pushing against the protrusions 162.

Accordingly, by making the protrusions 162 at the positioning portions 142 be on the inner wall surface 159 of the side wall 152 on the inside of the curve of the curved groove 171, as illustrated in FIG. 8, movement of the power line 110 in the direction I away from the bottom surface 153 is restricted at the positioning portions 142, as at the protrusions 162 of the positioning portions 141.

Thus, in the guide groove 90*c* in which the power line 110 is housed, in each of the straight grooves 172 at either end of the curved groove 171 in the groove length direction, are two of the protrusions 162 separated in the groove length direction, making for a total of four of the protrusions 162 that restrict movement of the power line 110 in the direction I away from the bottom surface 153.

As described above, the connection terminals 113, 114 at ends of the power line 110 in the length direction thereof are fixed to the power line retaining member 9 by screws and therefore do not lift out of the guide groove 90*c*. However, portions of the power line 110 other than the ends, in particular portions in the vicinity of the center of the power line 110 such as the portion 116 in a bent state housed in the curved groove 171, are far from the positions fixed by the screws and therefore lifting out of the guide groove 90*c* could easily occur.

According to the present embodiment, with respect to portions of the power line 110 other than the ends, four protrusions 162 are disposed along the length of the power line 110 at certain intervals, and therefore central portions of the power line 110 other than the ends are also prevented from lifting out of the guide groove 90*c*.

Further, according to the present embodiment, as illustrated in FIG. 6, the power line 110 is configured with a portion to be bent 112, which is a coil spring, and this makes the work of assembly fitting the power line 110 into the guide groove 90*c* easier.

This is because when the portion to be bent 112 of the power line 110 is housed in a curved groove 90*z* (see FIG. 4) of the guide groove 90*c*, the portion to be bent 112 is bent at substantially a right angle at a curvature greater than that of the corner portion 9*f*, and therefore if there were no coil spring and the portion to be bent 112 were a straight shape, a worker would have to use significant force on the power line 110 to bend it during assembly, requiring time and effort. This becomes more significant the greater the number of the power lines 110 to be housed.

Alternatively, for example, the portion to be bent 112 of the power line 110 may be formed bent at substantially a right angle by a pre-bending process, and not be a coil spring. However, if a discrepancy between the position of the bending process and the intended position were large, the bent portion of the power line 110 would not be possible to fit in the curved groove 90*z* during assembly, and workability would decrease due to the need to correct the discrepancy.

In contrast, by forming the portion to be bent 112 of the power line 110 as a coil spring, the coil spring has elasticity capable of stretching and bending, and therefore the power line 110 can be easily bent to substantially a right-angle without applying much force, making fitting simple. Further, even if manufacturing variation causes a discrepancy between the position of the coil spring and its intended position, a worker can stretch the coil spring a little and the elasticity of the coil spring allows easy fitting of the portion to be bent 112 into the curved groove 90*z*.

Thus, ease of assembly can be improved by forming a coil spring at the portion to be bent 112 of the power line 110, but forming a coil spring is just an example and depends on the configuration of the device.

For example, in a case in which the curved groove 90*z* has a relatively small curvature like the corner portion 9*f* (i.e., the curvature radius is large), or the power line 110 is composed of a material that can be bent with a relatively low force, or a similar case, even if the portion to be bent 112 were not a coil spring a worker could bend the power line 110 without requiring much time or effort. In such a case, the portion to be bent 112 can be used that is a straight shape and not formed into a coil spring.

Further, in this case, the power line 110 prior to housing in the guide groove 90 in a state in which external force is not applied, as in FIG. 6, is formed as a straight shape in which the portions to be bent 112, 116 are not bent, making a substantially straight shape along the length of the power line 110. Thus, the power lines 110 can be stored, managed in a warehouse, and transported in a low-cost packaging such as an elongated vinyl bag. By forming the power line 110 in a straight shape, space required for storage is small even when a plurality of the power lines 110 are bundled together and stored, and this is connected with decreased management costs.

The above describes an example configuration in which the protrusions 162 are on the inner wall surfaces 158, 159 of the side walls 151, 152 of the guide groove 90*c* in order to prevent the power line 110 of the power supply line 10*c* lifting out of the guide groove 90*c*. Similarly, with respect to the guide grooves 90*a*, 90*b*, and 90*d* to 90*h*, the protrusions 162 are spaced at intervals along the inner wall surfaces 158, 159 of the side walls 151, 152.

For example, in FIG. 5, looking at the guide groove 90*h* that houses the power supply line 10*h*, in the straight grooves 172 on either side of the curved groove 171 of the corner portion 9*f*, one of the straight grooves 171 has five protrusions 162*a*, 162*b*, 162*c*, 162*d*, 162*e*. These five of the protrusions 162 have the same size and shape as each other.

The protrusions 162*a*, 162*c*, 162*e* are on the inner wall surface 158 of the side wall 151 of the outside of the curve, spaced along the groove length direction with intervals therebetween. The protrusion 162*a* is closest to the curved groove 171 and the protrusion 162*e* is farthest from the curved groove 171.

On the other hand, the protrusions 162*b* and 162*d* are on the inner wall surface 159 of the side wall 152 of the inside of the curve, spaced along the groove length direction with an interval therebetween. The protrusion 162*b* is disposed between the protrusions 162*a* and 162*c*. The protrusion 162*d* is disposed between the protrusions 162*c* and 162*e*.

In other words, as distance increases from the curved groove 171 in the groove length direction, the protrusions 162 alternate disposition on the inner wall surfaces 158, 159 in the order 158, 159 158, 159, 158. Thus, as in the state indicated by the dot-dash line 110*b* in FIG. 10, each of the protrusions 162 is pressed against by the power line 110 attempting to return to its original straight shape, restricts movement of the power line 110 in the direction I away from the bottom surface 153, and prevents the power line 110 from lifting out of the guide groove.

In the straight groove 172 at the other end of the guide groove 90*h* illustrated in FIG. 5, the protrusion 162 is on the inner wall surface 158 of the side wall 151 on the outside of the curve. This protrusion 162 restricts movement of the power line 110 in the direction I away from the bottom surface 153, and prevents the power line 110 from lifting out.

As described above, for each of the guide grooves 90, for each of the inner wall surfaces 158, 159 of the side walls 151, 152, two or more of the protrusions 162 are spaced along the groove length direction, but this is just an example. It suffices that the protrusions 162 can prevent the power lines 110 from lifting out.

For example, in FIG. 8 two of the protrusions 162 are illustrated in each of the straight grooves 172, but a configuration is possible in which each of the straight grooves 172 has only the protrusion 162 nearest to the curved groove 171, and the protrusions 162 that are farther from the curved groove 171 are not provided. In this case, for example in the guide groove 90*c*, a guide groove that has the function of preventing lifting out of the power line 110 can be achieved by the protrusions 162 in the portion of the guide groove between positions 99*a* and 99*b* in the groove length direction.

Further, the protrusions 162 are not limited to being in the straight grooves 172 and may be provided at one or both ends in the groove length direction of the curved groove 171 on the inner wall surface 158 of the side wall 151 on the outside of the curve. Furthermore, the protrusions 162 need not be in the straight grooves 172 at all and may be provided only on the side wall 151 of the curved groove 171. Within ranges that can prevent lifting up of the power lines 110, the number, position, etc., of the protrusions 162 can be determined by experimentation, etc.

<Modifications>

Description is provided above based on an embodiment of the present invention, but the present invention is of course not limited to the embodiment described above, and modifications such as described below may be considered.

(1) According to the embodiment, the portion 116 of the power line 110, which is a portion to be bent, is a straight shape when no external force is applied to it and it is not housed in the curved groove 171 of the guide groove 90*c*.

It suffices that, when the power line 110 is housed in the curved groove 171 of the guide groove 90*c* in a bent state, the power line 110 attempts to return to its original shape due to a restoring force generated by its own elasticity, and the power line 110 presses against the inner wall surface of at least one of the side walls 151, 152 of the guide groove 90*c*. The protrusions 162 can be formed on the inner wall surface that is pressed against by the power line 110.

(2) According to the embodiment, the protrusions 162 are described as each having the base portion 16*a* and the projection 16*b*, but this is just an example. It suffices that restricting portions are provided on the inner wall surface of the guide groove that restrict movement of the power line 110 in a direction away from the bottom surface of the guide groove when the power line 110 is in contact with and pressing against the inner wall surface of the guide groove due to the restoring force of the power line 110.

Figure 11A:
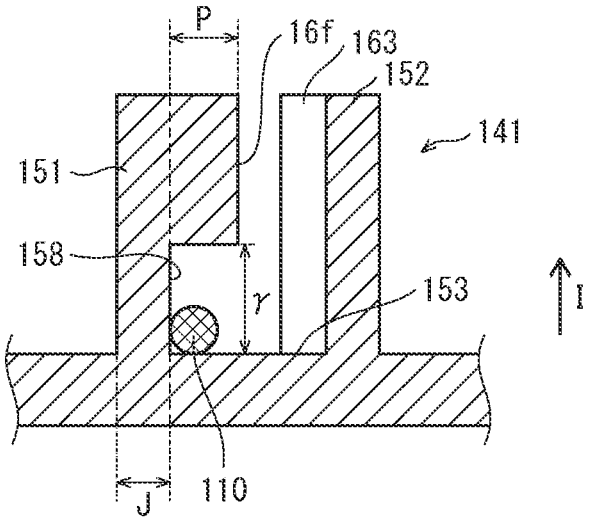
FIG. 11A and FIG. 11B are cross sections illustrating projections pertaining to modifications.
Figure 11B:
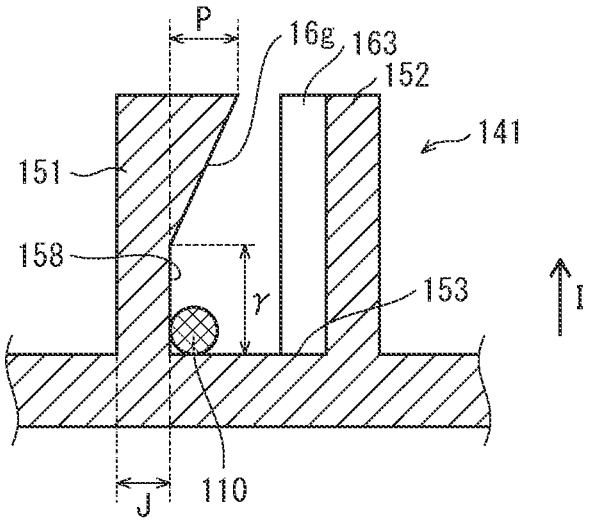

For example, as illustrated in FIG. 11A, on the inner wall surface 158 of the side wall 151 of thickness J, at a position a distance γ from the bottom surface 153, a projection 16*f* may be provided that is rectangular in cross-section and projects a constant amount P from the inner surface wall 158. As another example, as illustrated in FIG. 11B, on the inner wall surface 158 of the side wall 151, as a position a distance γ from the bottom surface 153, a projection 16*g* may be provided that is triangular in cross-section and projects an amount P from the inner surface wall 158, the amount P increasing steadily as the distance I from the bottom surface 153 increases. The projections 16*f*, 16*g* function as restricting portions.

(3) According to the embodiment, an example is described of the portion 116, which is straight when not housed in the guide groove 90 and no external force is applied thereto, and which is a portion of the power line 110, which is a bare metal wire that has elasticity. The portion 116 is housed in the curved groove 172 and the straight groove 171 of the guide groove 90. However, in plan view, the shapes of the guide groove 90 and the power line 110 when not elastically deformed need not be the straight and curved shapes described.

It suffices that the power line has a different shape when it is housed in the guide groove to when it is not elastically deformed, and that when the power line is forcibly housed in the guide groove, the power line that attempts to return to its original shape due to the restoring force of the power line's elasticity presses against at least one of the inner wall surfaces of the side walls of the guide groove.

Figure 12A:
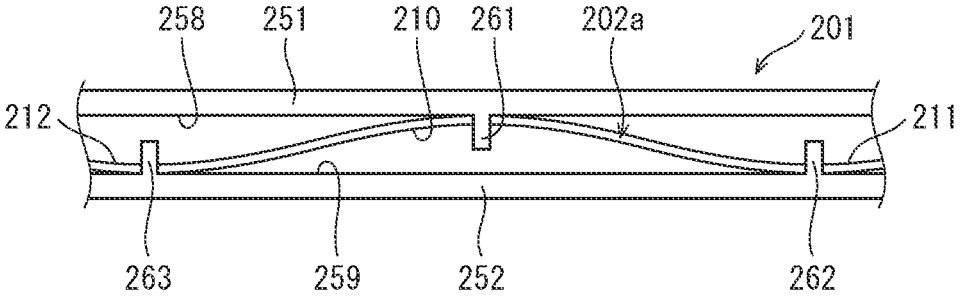
FIG. 12A and FIG. 12B illustrate a groove and power lines pertaining to modifications.
Figure 12B:
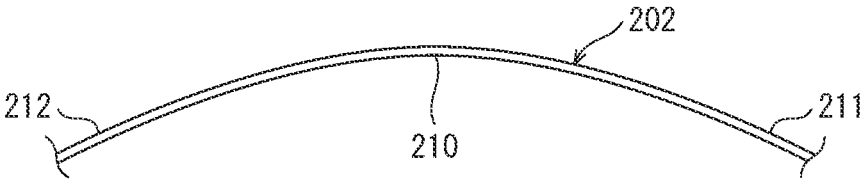

More specifically, the configuration illustrated in FIG. 12A and FIG. 12B is possible.

As illustrated in FIG. 12A, a power line 202 that has a different shape when it is housed in the guide groove to when it is not elastically deformed, for example a bent or curved bare wire such as illustrated in FIG. 12B, is housed in a guide groove 201. When the power line 202, which has a bent or curved shape when not elastically deformed, is forcibly housed in the guide groove 201, which is straight, a portion 210 of the power line 202*a* that is attempting to return to its original shape due to the restoring force of its own elasticity presses against and contacts an inner wall surface 258 of a side wall 251.

The inner wall surface 258 contacted by the portion 210 of the power line 202*a* is configured with a projection 261 that has the same shape as the projection 16*f*.

Further, projections are not limited to the inner wall surface 258, and may also be provided on an inner wall surface 259 of a side wall 252 that is pressed against by portions 211, 212 of the power line 202*a* housed in the guide groove 201. Projections 262, 263 have the same shapes as the projection 261. As long as lifting out of the power line 202*a* can be prevented, only one protrusion among the protrusions 261, 262, 263, for example, need be provided.

A plan view of the power line 202 when not elastically deformed need not be limited to a bent or curved shape, for example when the guide groove is a straight shape the power line may have an "S" shape.

(4) According to the embodiment, an example is described in which the power supply line 10 is disposed to supply the charger bias voltage and the developer bias voltage outputted from the high voltage power supply board 8 to the imaging units 3Y, 3M, 3C, 3K, but this is just an example. For example, in a configuration in which power is supplied from the high voltage power supply board 8 to a heater of the fixing unit 6, the power line retaining member is applicable to lines supplying such power.

Further, components that supply power are not limited to the high voltage power supply board 8, and may be power supplies such as other power supply boards. Components that receive power are also not limited to the imaging units 3Y, 3M, 3C, 3K and the fixing unit 6, and may be other components such as motors. Further, in a configuration in which a plurality of the output terminals 81 are on the high voltage power supply board 8, one power source (component) may be considered for each one of the output terminals 81.

In an image forming device such as the printer 1, the power line retaining member may typically be applied to housing and retaining, in a guide groove, a power line that is a bare metal wire for electrically connecting two separate components. Further, it suffices that the power line retaining member has guide grooves that are electrically insulative, for example the guide grooves 90 of the first retaining board 9*a* and the second retaining board 9*b* of the power line retaining member 9 may be formed integrally as one body from, for example, insulating resin, or the material of the power line retaining member may be electrically conductive and the bottom surface, inner wall surface, protrusions, etc., of the guide grooves treated by an insulting process such as the adding of an insulating layer or membrane. All configurations are included in electrically insulative guide grooves.

(5) According to the embodiment, a tandem-type color printer is described as the image forming device, but this is just an example. The image forming device may be a printer that can only form monochrome images, and is not limited to electrophotographic systems. For example, the image forming device may be an inkjet-type. Further, the image forming device is not limited to being a printer, and any typical image forming device is applicable, such as a photocopier, facsimile machine, or multi-function peripheral (MFP).

Further, shape and length of the power supply line 10, length of the power line 110, position and number of the portion 116, shape and material of the power line retaining member 9, shape, path, length, and number of the guide grooves 90, shape and number of the protruding portions 160, 161, 162, 163, etc., are not limited to the examples given, and depending on the device, appropriate values may be determined in advance.

Further, the content of the embodiment and the modifications above may be combined where possible. Within a scope that can achieve the effects of the invention, structure of each element and each material may be replaced by another structure and/or material.

<Summary>

The content of the embodiment and the modifications illustrate one aspect for solving the technical problem described under the heading RELATED ART, and a summary of the embodiment and the modifications is as follows.

One aspect of the present invention is a power line retaining member that houses, in a groove, a power line for connecting two separate components of an image forming device, the power line being a bare metal wire that has elasticity, the power line retaining member comprising: a guide that includes two side walls, internal wall surfaces of the two side walls and a bottom surface between the internal wall surfaces being electrically insulative and defining the groove, the guide holding the power line in an elastically deformed shape; and a restricting portion disposed on an internal wall surface that the power line exerts a restoring force against, the restricting portion restricting movement of the power line in a direction away from the bottom surface.

The power line retaining member may be configured so the groove includes a first groove portion that describes a curve and a second groove portion that is straight and continuous with the first groove portion, the power line held in the first groove portion and the second groove portion has a straight shape when not deformed, and the restricting portion is disposed in the second groove portion on the internal wall surface of the side wall on the outside of the curve.

The power line retaining member may further comprise: a second restricting portion disposed in the second groove portion on the internal wall surface of the side wall on the inside of the curve, the second restricting portion being further away from the first groove portion than the restricting portion and restricting movement of the power line in the direction away from the bottom surface.

The power line retaining member may further comprise: protruding portions disposed in the first groove portion on the internal wall surfaces of the side walls, the protruding portions determining positioning, in a width direction of the groove, of the power line housed in the first groove portion.

The power line retaining member may be configured so the restricting portion is a protrusion that protrudes from an internal wall surface.

The power line retaining member may be configured so the restricting portion includes a first portion and a second portion that is that is continuous with the first portion and farther from the bottom surface than the first portion, and the second portion protrudes farther from the internal wall surface than the first portion.

The power line retaining member may be configured so a step is formed between the first portion and the second portion by a difference in how far the first portion and the second portion protrude from the internal wall surface.

The power line retaining member may further comprise: protruding portions disposed on the internal wall surface of a side wall opposite the internal wall surface of a side wall on which the restricting portion is disposed, either side of the restricting portion in a length direction of the groove, the protruding portions determining positioning, in a width direction of the groove, of the power line housed in the groove.

The power line retaining member may be configured so the restricting portion is a first protrusion that protrudes from the internal wall surface of a side wall, the protruding portions are second protrusions that protrude from the internal wall surface of the side wall opposite the restricting portion, and a gap in the width direction between the first protrusion and the second protrusions is substantially equal to a diameter of the power line.

Another aspect of the present invention is an image forming device that comprises: two components used in image forming; a power line connecting the two components, the power line being a bare metal wire having elasticity; and a power line retaining member that houses the power line in a groove, the power line retaining member comprising: a guide that includes two side walls, internal wall surfaces of the two side walls and a bottom surface between the internal wall surfaces being electrically insulative and defining the groove, the guide holding the power line in an elastically deformed shape; and a restricting portion disposed on an internal wall surface that the power line exerts a restoring force against, the restricting portion restricting movement of the power line in a direction away from the bottom surface.

The image forming device may further comprise: an image carrier; a charger that charges the image carrier; an exposure unit that exposes the charged image carrier to a light beam, forming an electrostatic latent image; a developing unit that develops the electrostatic latent image formed on the image carrier by using a developer; and a power supply unit that supplies a bias voltage to the charger and supplies a bias voltage to the developing unit, wherein the two components are the charger and the developing unit.

According to the configuration described above, a power line that is a bare wire and housed in a guide groove maintains a state of pressing against an inner wall surface of a side wall of the guide groove due to a restoring force of the power line that attempts to return the power line to its original shape; even if the power line would move in a direction away from a bottom surface of the guide groove, a restricting portion on the inner wall surface restricts such movement.

Thus, there is no need to perform work such as fixing the power line housed in the guide groove by using a separate retaining member, lifting out of the guide groove is prevented, and ease of assembly is improved in comparison to other configurations that require additional work.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A power line retaining member that houses, in a groove, a power line for connecting two separate components of an image forming device, the power line being a bare metal wire that has elasticity, the power line retaining member comprising:

a guide that includes two side walls, internal wall surfaces of the two side walls and a bottom surface between the internal wall surfaces being electrically insulative and defining the groove, the guide holding the power line in an elastically deformed shape;

a restricting portion disposed on an internal wall surface that the power line exerts a restoring force against, the restricting portion restricting movement of the power line in a direction away from the bottom surface; and protruding portions disposed on the internal wall surface of a side wall opposite the internal wall surface of a side wall on which the restricting portion is disposed, either side of the restricting portion in a length direction of the groove, the protruding portions determining positioning, in a width direction of the groove, of the power line housed in the groove.

2. The power line retaining member of claim 1, wherein the groove includes a first groove portion that describes a curve and a second groove portion that is straight and continuous with the first groove portion, the power line held in the first groove portion and the second groove portion has a straight shape when not deformed, and the restricting portion is disposed in the second groove portion on the internal wall surface of the side wall on the outside of the curve.

3. The power line retaining member of claim 2, further comprising:

a second restricting portion disposed in the second groove portion on the internal wall surface of the side wall on the inside of the curve, the second restricting portion being further away from the first groove portion than the restricting portion and restricting movement of the power line in the direction away from the bottom surface.

4. The power line retaining member of claim 2, further comprising:

protruding portions disposed in the first groove portion on the internal wall surfaces of the side walls, the protruding portions determining positioning, in a width direction of the groove, of the power line housed in the first groove portion.

5. The power line retaining member of claim 1, wherein the restricting portion is a protrusion that protrudes from an internal wall surface.

6. The power line retaining member of claim 5, wherein the restricting portion includes a first portion and a second portion that is that is continuous with the first portion and farther from the bottom surface than the first portion, and the second portion protrudes farther from the internal wall surface than the first portion.

7. The power line retaining member of claim 6, wherein a step is formed between the first portion and the second portion by a difference in how far the first portion and the second portion protrude from the internal wall surface.

8. The power line retaining member of claim 1, is wherein the restricting portion is a first protrusion that protrudes from the internal wall surface of a side wall, the protruding portions are second protrusions that protrude from the internal wall surface of the side wall opposite the restricting portion, and a gap in the width direction between the first protrusion and the second protrusions is substantially equal to a diameter of the power line.

9. An image forming device comprising:

two components used in image forming;

a power line connecting the two components, the power line being a bare metal wire having elasticity; and a power line retaining member that houses the power line in a groove, the power line retaining member comprising:

a guide that includes two side walls, internal wall surfaces of the two side walls and a bottom surface between the internal wall surfaces being electrically insulative and defining the groove, the guide holding the power line in an elastically deformed shape;

a restricting portion disposed on an internal wall surface that the power line exerts a restoring force against, the restricting portion restricting movement of the power line in a direction away from the bottom surface; and protruding portions disposed on the internal wall surface of a side wall opposite the internal wall surface of a side wall on which the restriction portion is disposed, either side of the restriction portion in length direction of the groove, the protruding portions determining positioning, in a width direction of the groove, of the power line housed in the groove.

10. The image forming device of claim 9, further comprising:

an image carrier;

a charger that charges the image carrier;

an exposure unit that exposes the charged image carrier to a light beam, forming an electrostatic latent image;

a developing unit that develops the electrostatic latent image formed on the image carrier by using a developer; and a power supply unit that supplies a bias voltage to the charger and supplies a bias voltage to the developing unit, wherein the two components are the charger and the developing unit.

* * * * *